US011564436B2

(12) United States Patent
Lauser, Jr. et al.

(10) Patent No.: US 11,564,436 B2
(45) Date of Patent: Jan. 31, 2023

(54) ACCESSORY MOUNT FOR HELMET SHROUD AND METHODS OF USING THE SAME

(71) Applicant: Intellectual Property Holdings, LLC, Cleveland, OH (US)

(72) Inventors: Adam John Lauser, Jr., Chesterland, OH (US); Jon Adlard Hauserman, Seven Hills, OH (US); Ron Szalkowski, Lakewood, OH (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 19 days.

(21) Appl. No.: 16/749,966

(22) Filed: Jan. 22, 2020

(65) Prior Publication Data

US 2021/0076766 A1 Mar. 18, 2021

Related U.S. Application Data

(60) Provisional application No. 62/795,307, filed on Jan. 22, 2019.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406
USPC ..... 2/422
See application file for complete search history.

(56) References Cited

U.S. PATENT DOCUMENTS

| | | | | |
|---|---|---|---|---|
| 4,764,989 | A * | 8/1988 | Bourgeois | A42B 3/185 2/10 |
| 7,441,737 | B2 * | 10/2008 | Bae Park | A42B 1/247 248/292.12 |
| D817,554 | S | 5/2018 | O'Connell | |
| 2011/0145981 | A1 | 6/2011 | Teetzel et al. | |
| 2017/0245574 | A1 * | 8/2017 | Danko | A42B 1/0184 |

* cited by examiner

*Primary Examiner* — Timothy K Trieu
(74) *Attorney, Agent, or Firm* — Calfee, Halter & Griswold LLP

(57) ABSTRACT

An exemplary accessory mount for securing an accessory to a helmet includes a body, a moveable arm, and a hinge portion. The body has a top, bottom, and first and second sides. A fixed tab extends from the bottom of the body and a moveable tab extends from a top of the moveable arm. The hinge portion hingeably attaches the moveable arm to the top of the body proximate one of the first and second sides.

14 Claims, 11 Drawing Sheets

ACCESSORY MOUNT FOR HELMET SHROUD AND METHODS OF USING THE SAME

CROSS-REFERENCE TO RELATED APPLICATIONS

This application claims the benefit of U.S. Provisional Patent Application No. 62/795,307, filed Jan. 22, 2019, and entitled ACCESSORY MOUNT FOR HELMET SHROUD AND METHODS OF USING THE SAME , the entire disclosure of which is hereby incorporated herein by reference in its entirety.

TECHNICAL FIELD

The present application relates generally to accessory mounting devices and in particular to an accessory mounting device for a helmet shroud and methods of using the same.

BACKGROUND OF THE INVENTION

Helmets, particularly in military and tactical environments, are utilized as platforms for mounting a variety of accessories. This may include night vision goggles, lights, battery packs, visual beacons and other devices. A common accessory mounting method for helmets, particularly helmets used by the military, includes a mounting plate or receptacle—sometimes referred to as a "shroud"—that is bolted directly to the front of the helmet shell. Such shrouds are shown in, for example, U.S. Design Pat. No. D817,554 to O'Connell and U.S. Published Patent Application No. 2011/0145981 to Teetzel et al.

Such mounts utilize adjustable tabs that can be retracted into the mount for positioning in the mounting plate, then extended to interface with the plate and secure the mount. These adjustable tabs may be selected into different positions, sometimes locked or set to a certain breakaway strength. Additionally, other mounts, such as for cameras and headlamps, have been adapted to fit these same mounting plates or receptacles, and use a button operated, spring loaded, adjustable tab that can be retracted into the mount such that the mount can be positioned in the mounting plate, and then the tab retracted to lock the mount into the mounting plate (prior art shown below).

SUMMARY

The present application discloses an accessory mount for a helmet and methods of using the same. In an exemplary embodiment, the accessory mount includes a body, a moveable arm, and a hinge portion. The body has a top, bottom, and first and second sides. A fixed tab extends from the bottom of the body and a moveable tab extends from a top of the moveable arm. The hinge portion hingeably attaches the moveable arm to the top of the body proximate one of the first and second sides.

A further understanding of the nature and advantages of the present invention are set forth in the following description and claims, particularly when considered in conjunction with the accompanying drawings in which like parts bear like reference numerals.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which.

DETAILED DESCRIPTION

Figure 1:
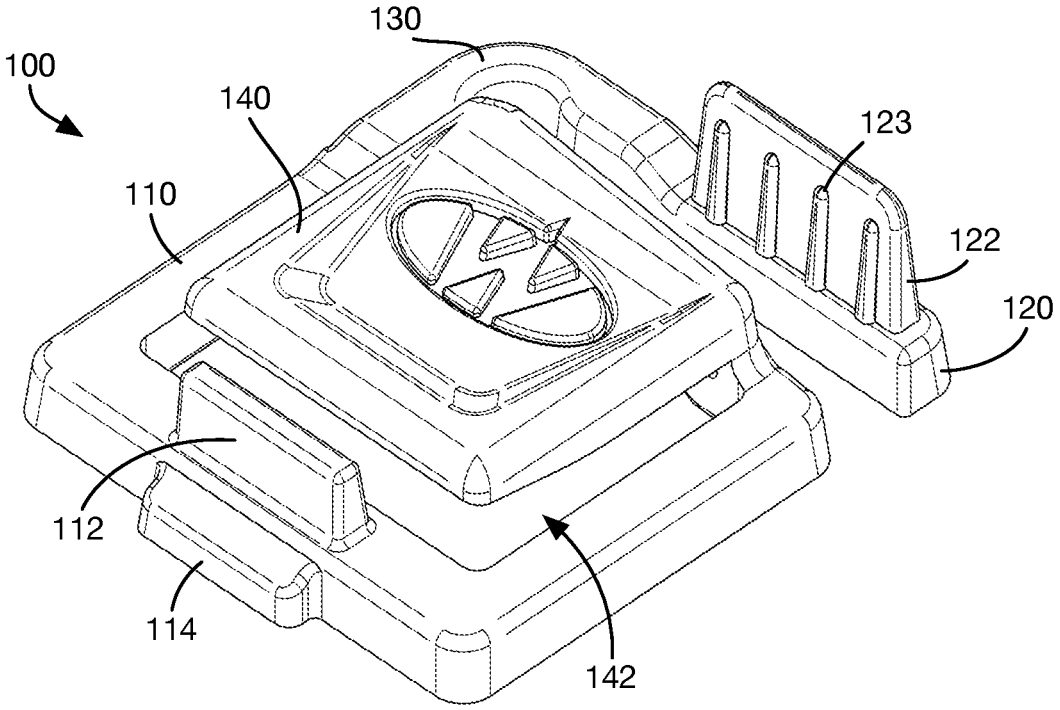
FIG. 1 is a front perspective view of an exemplary accessory mount.
Figure 2:
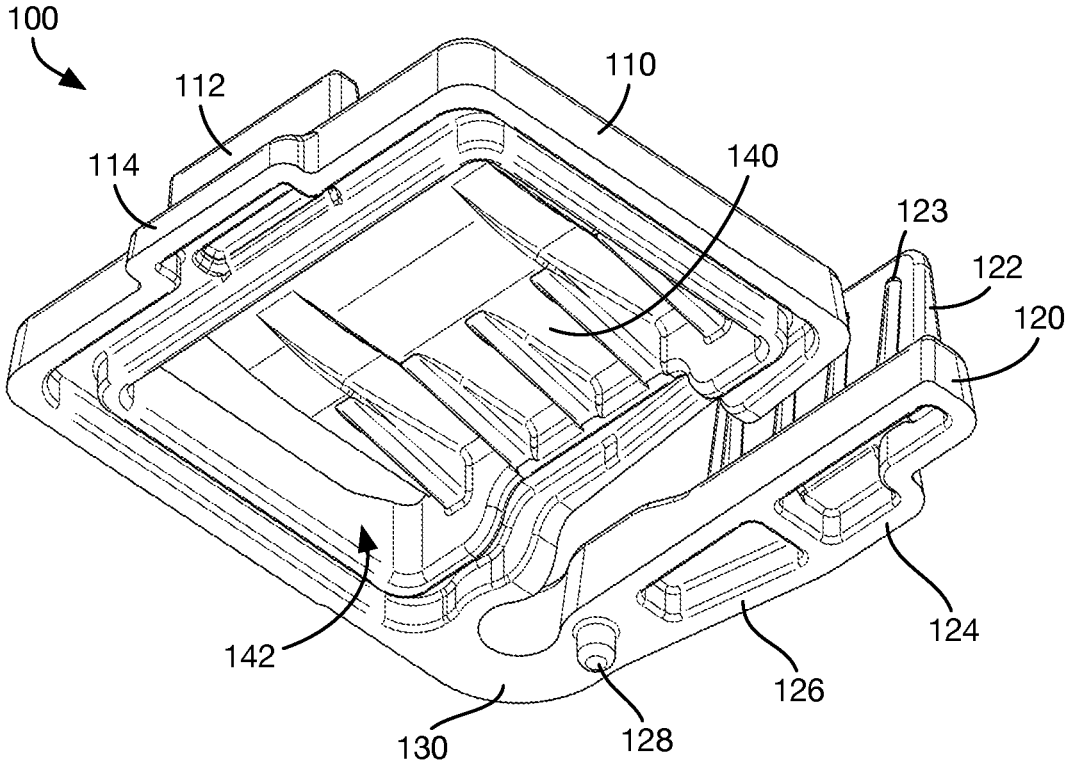
FIG. 2 is a rear perspective view of the accessory mount of FIG. 1.
Figure 5:
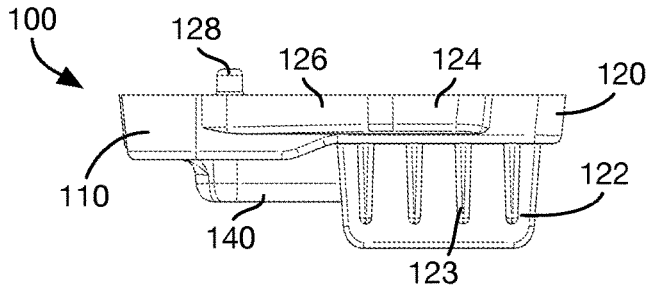
FIG. 5 is a top view of the accessory mount of FIG. 1.

The following description refers to the accompanying drawings, which illustrate specific embodiments of the present disclosure. Other embodiments having different structures and operation do not depart from the scope of the present disclosure.

Exemplary embodiments of the present disclosure are directed to accessory mounts for attaching accessories to helmets and methods of using the same. It should be noted that various embodiments of accessory mounts are disclosed herein, and any combination of these options can be made unless specifically excluded. In other words, individual components or portions of the disclosed mounts can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

The present application discloses an accessory mount for attaching accessories to a mounting plate or "shroud" of a helmet, such as military or tactical helmets. Exemplary accessory mounts are described herein that include at least two tabs that extend outward to engage recesses or openings in the helmet shroud. At least one tab is moveable such that the tab can be retracted from the recess of the shroud to enable the accessory amount and the attached accessory to be removed from the helmet. The tabs that interface with the mounting plate or shroud are sized to restrict the movement of the accessory mount when attached to the helmet to allow for a secure fit of accessories and to prevent the release of the accessory mount from the mounting plate or shroud by inadvertent movement of the moveable tab.

The accessory mounts disclosed herein are made from a single piece of material while maintaining the ability to clip into the recesses of the helmet shroud. The material used to form the accessory mounts (e.g., accessory mounts 100, 200, 300 described below) can be thermoplastic resin, thermoset resin, and UV curable resin produced by injection molding or with additive manufacturing, as well as metals with high elasticity such as titanium, and composites that include carbon fiber, aramid, and fiberglass.

Referring now to FIGS. 1-7, an exemplary accessory mount 100 is shown. The accessory mount 100 has a body 110 having a bottom actuating portion 112 and a fixed bottom tab 114. A moveable arm or portion 120 is hingeably attached to the body 110 by a hinge portion 130 arranged at a left side of the body 110. The moveable arm 120 includes a top actuating portion 122 and a moveable top tab 124. An accessory mounting portion 140 extends from the body 110 for attaching an accessory to the accessory mount 100.

Figure 3:
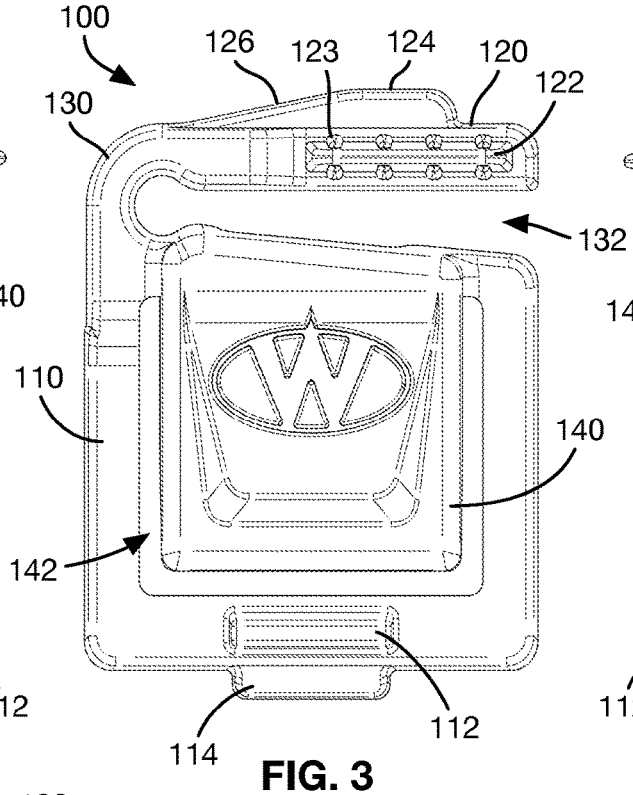
FIG. 3 is a front view of the accessory mount of FIG. 1.

As can be seen in FIG. 3, the body 110 has a generally rectangular shape with rounded corners and is configured to fit within the rectangular recess of a helmet shroud (not shown). The body 110 can be any shape that corresponds to the recess or receptacle of a helmet. The rectangular shape of the body 110 as shown in FIGS. 1-7 prohibits the rotation of the mount 100 within a similarly shaped recess of a helmet shroud.

Figure 6:
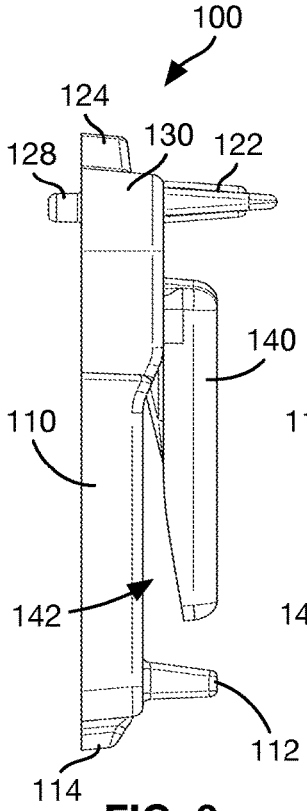
FIG. 6 is a left side view of the accessory mount of FIG. 1.
Figure 7:
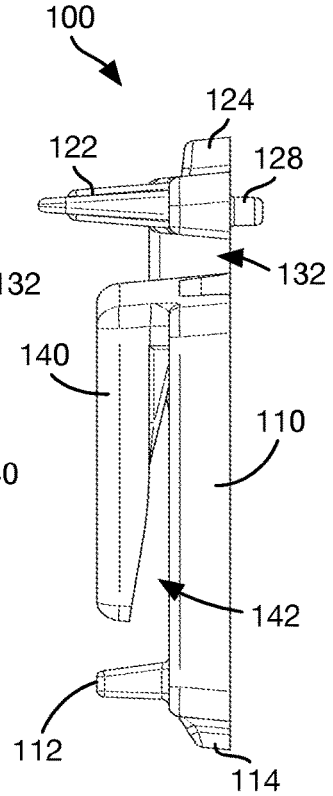
FIG. 7 is a right side view of the accessory mount of FIG. 1.
Figure 4:
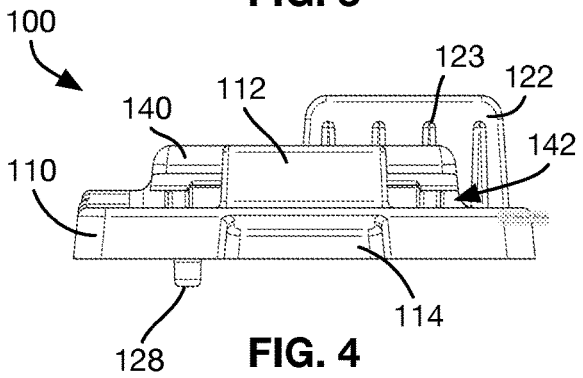
FIG. 4 is a bottom view of the accessory mount of FIG. 1.

The bottom actuation portion 112 extends outward from the body 110 proximate the location of the fixed bottom tab 114. The bottom actuation portion 112 is configured to receive actuation force applied by the fingers of the wearer of the helmet. As can be seen in FIGS. 6 and 7, the bottom actuation portion 112 does not extend as far from the body 110 as the top actuation portion 122 so as to avoid contact with an accessory attached to the accessory mount 100.

The fixed bottom tab 114 extends from the bottom of the body 110 and has a rounded rectangular shape. The fixed bottom tab 114 is shaped to conform to a recess in the bottom side of the rectangular recess of the helmet shroud. That is, the fixed bottom tab 114 is roughly the same width as the recess so as to prohibit lateral movement of the fixed bottom tab 114 and, consequently, the accessory mount, within the recess of the shroud.

The moveable arm 120 extends from the hinge portion 130 along the top of the accessory mount 100. The moveable arm 120 can be configured to conform to the shape of the top edge of the rectangular recess of the helmet shroud. The moveable arm 120 is moveable toward the body 110 to retract and extend the moveable tab 124. The hinge portion 130 biases the moveable arm 120 in an opening direction so that the moveable arm 120 remains in contact with or close to a top edge of the shroud recess so that the moveable top tab 124 remains engaged with the shroud. The moveable arm 120 optionally includes a pin 128 that extends below the moveable arm 120 to engage features of certain helmet shrouds (not shown) to restrict lateral movement of the accessory mount 100.

The top actuation portion 122 extends outward from the moveable arm 120 proximate the end of the moveable arm 120—that is, at a distance from the hinge portion 130—to provide leverage when applying an actuation force to actuate the moveable arm 120. The top actuation portion 122 is configured to receive actuation force applied by the fingers of the wearer of the helmet. In embodiments where the accessory attached to the accessory mount 100 does not extend vertically above the accessory mounting portion 140, the top actuation portion 122 extends away from the moveable arm 120 more than the bottom actuation portion 112 extends from the body 110 to provide a large surface for actuating the accessory mount 100. In certain embodiments, the actuation portion 122 include grip enhancing features 123 that improve the grip of the user when actuating the top actuation portion 122, such as ridges shown in FIGS. 1-7. The grip enhancing features 123 also enable the user to feel the location of the top actuation portion 122 without looking so that the top actuation portion 122 can be actuated without removing the helmet.

The moveable top tab 124 extends from the top of the moveable arm 120 and has a rounded rectangular shape on the side furthest from the hinge portion 130 and an incline or ramp portion 126 on the side nearest the hinge portion 130. The moveable top tab 124 is shaped to conform to a recess in the top side of the rectangular recess of the helmet shroud. That is, the moveable top tab 124 is roughly the same width as the recess so as to prohibit lateral movement of the moveable top tab 124 and, consequently, the accessory mount, within the recess of the shroud.

The accessory mount 100 is actuated by pinching the bottom and top actuating portions 112, 122 together to cause the moveable arm 120 to move toward the body 110, thereby retracting the moveable top tab 124 so that the accessory mount 100 can fit within the recess of the helmet shroud. Alternatively, actuation force is applied to the top actuation portion 122 while the bottom tab 114 is engaged with the helmet shroud so that upward force does not need to be applied to the bottom actuating portion 112 to actuate the accessory mount 100.

The hinge portion 130 allows the moveable arm 120 to pivot relative to the body 110 of the accessory mount 100. The hinge portion 130 is formed from the same material as the body 110 and moveable arm 120 and is a "living hinge" in that the hinge portion 130 elastically deforms as an actuation force is applied to the actuation portion 122 of the moveable arm 120 causing the moveable arm to flex toward the body 110 and returns to a neutral position when the actuation force is removed. That is, the hinge portion 130 operates as a rotational spring that resists deformation and generates a restorative force when a force causing the deformation subsides.

The hinge portion 130 spaces the moveable arm 120 apart from the body 110 to form a gap 132 that is reduced as the moveable arm 120 is actuated. As can be seen in FIG. 3, the gap 132 widens as the gap 132 extends away from the hinge portion 130. The widening of the gap 132 provides clearance for the movement of the moveable arm 120 during actuation and is configured such that when the movable arm 120 is at or near a maximum actuation position where the moveable arm 120 is in contact with the body 110, the tapered portion 126 of the moveable top tab 124 is approximately horizontal so that the moveable top tab 124 clears the top side of the shroud recess and the accessory mount 100 can be removed from the shroud.

The accessory mounting portion 140 can take many forms, such as the retention clip shown in FIGS. 1-7. In the illustrated embodiment, a gap 142 is formed between the accessory mounting portion 140 and the body 110 and is sized to receive a strap (not shown) of a headlamp or other accessory. The body 110 optionally includes an opening behind the accessory mounting portion 140 that provides clearance for the strap that extends through the gap 142 between the accessory mounting portion 140 and the body 110. In certain embodiments, the accessory mounting portion 140 can be configured as a mounting plate (not shown) instead of the retention clip for attaching accessories through any suitable attachment or fastening means, such as, for example, with bolts, screws, clips, tabs, or posts.

In the illustrated embodiment, the accessory mounting portion 140 is configured as a retention clip spaced apart from the body 110 by the gap 142. The retention clip configuration of the accessory mounting portion 140 can be used to secure the elastic strap of a headlamp. Headlamps with such elastic straps are common for wearing on the head or on a helmet. When worn on a helmet such headlamps have a tendency to shift or slide up due to the domed shape and often smooth outer surface of a helmet shell. The retention clip from the mount 100 allows the elastic strap to be routed through the gap 142 to prohibit the strap from sliding upwards and thus providing additional security to the attachment of the headlamp to the helmet. Many such headlamps with elastic straps utilize straps that form a fully circular shape, including running directly behind the body of the headlamp itself so that the portion of the strap arranged behind the headlamp can be positioned behind the accessory mounting portion 140 of the accessory mount 100, Thus, when the shroud is positioned in the front center of the helmet, as current shrouds typically are, the accessory mount 100 further serves to center the headlamp on the helmet.

The accessory mount 100 is attached to the helmet shroud by first aligning or locating the bottom fixed tab 114 in the bottom recess of the shroud. Actuation force is then applied to the top actuation portion 122 to move the moveable arm 120 toward the body 110 so that the moveable top tab 124 can fit within the recess of the shroud. The accessory mount 100 (and any attached accessory) are then tilted backward toward the helmet until the accessory mount 100 is fully inserted into the recess of the shroud. The actuation force is then released and the hinge portion 130 causes the moveable arm 120 to move away from the body 110 so that the moveable top tab 124 is inserted into the top recess of the helmet shroud, thereby securing the accessory mount within the shroud recess.

The accessory mount 100 is removed from the helmet shroud by first applying actuation force to the top actuation portion 122 to move the moveable arm 120 toward the body 110 so that the moveable top tab 124 is retracted from the recess of the helmet shroud. The accessory mount 100 (and any attached accessory) are then tilted forward away from the helmet until the top of accessory mount 100 is fully removed from the recess of the shroud. The accessory mount 100 and attached accessory can then be lifted away from the helmet.

In certain embodiments, a distance from the top of the moveable arm to the top of the body is less than about 30 percent, or less than about 25 percent, or less than about 20 percent, or less than about 15 percent of a total height of the accessory mount. Thus, a flexible portion of the accessory mount 100—i.e., the moveable arm 120 and hinge portion 130—makes up less than 30 percent of the total height of the accessory mount 100. Consequently, the body 110 of the accessory mount 100 is about 70 percent or less of the total height of the accessory mount 100. The relative proportions of the body 110 and the flexible portion of the accessory mount 100 provide further resistance to the rotation of the accessory mount 100 within the recess of the helmet shroud.

External forces, such as gravity or forces from impacts with other objects, exerted on the mounted accessory are transmitted through the accessory mounting portion 140 to the body 110 of the accessory mount 100 and then to the helmet shroud. Lateral and downward forces applied to the accessory mount 100 have little or no impact on the position or actuation of the moveable arm 120 so that later and downward forces are not capable of inadvertently actuating the movable arm 120 to release the accessory mount 100 from the shroud. Upward forces similarly have little or no impact on the position or actuation of the moveable arm 120 in that the moveable arm 120 pivots at the hinge portion 130 which is arranged at one side of the accessory mount 100. Thus, to actuate the moveable arm 120 with upward forces, the body 110 would have to pivot relative to the moveable arm 120 and the body 110 is prohibited from such movement by engagement with the helmet shroud. The bottom fixed tab 114 and the pin 128 also aid restricting lateral movement of the accessory mount 100. Consequently, the accessory mount 100 can only be released by applying an actuation force to the actuation portion 122 of the moveable arm 120 to move the moveable arm 120 in a downward direction.

Figure 8:
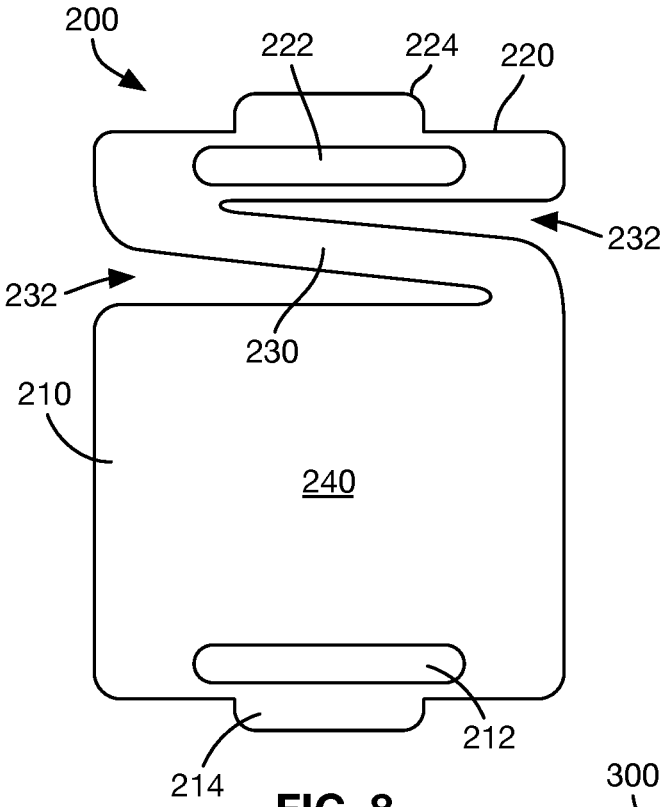
FIG. 8 is a front view of an exemplary accessory mount.

Referring now to FIG. 8, an exemplary accessory mount 200 is shown. The accessory mount 200 is like the accessory mount 100 described above and includes a body 210, a moveable arm 220, a hinge portion 230, and an accessory mounting portion 240. A bottom actuation portion 212 and a fixed bottom tab 214 extend from the body 210. A top actuation portion 222 and a moveable top tab 224 extend from the moveable arm 220. Unlike the accessory mount 100 described above, the hinge portion 230 extends diagonally across the width of the accessory mount 200 and forms two gaps 232. When the accessory mount 200 is actuated by pinching the bottom and top actuation portions 212, 222, the hinge portion 230 deforms at each end so that the moveable arm 220 moves towards the body 210 while maintaining a horizontal orientation. The travel of the hinge portion 230 allows the moveable top tab 224 to retract toward the body 210 enough that the accessory mount 200 can be installed or removed from the recess of the helmet shroud. Like the accessory mount 100 described above, the hinge portion 230 resists actuation force applied to the moveable arm 220 so that the accessory mount 200 is not inadvertently released from the helmet shroud.

Figure 9:
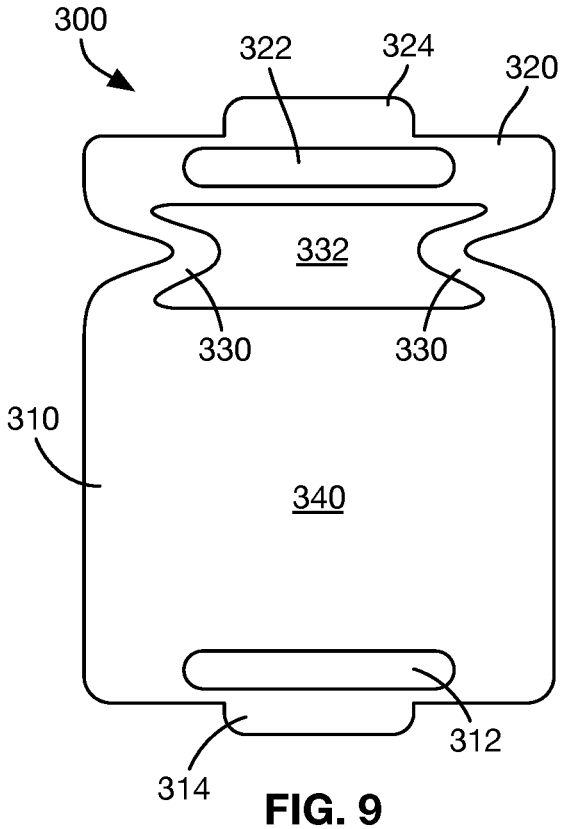
FIG. 9 is a front view of an exemplary accessory mount.

Referring now to FIG. 9, an exemplary accessory mount 300 is shown. The accessory mount 300 is like the accessory mounts 100, 200 described above and includes a body 310, a moveable arm 320, a hinge portion 330, and an accessory mounting portion 340. A bottom actuation portion 312 and a fixed bottom tab 314 extend from the body 310. A top actuation portion 322 and a moveable top tab 324 extend from the moveable arm 320. Unlike the accessory mounts 100, 200 described above, the accessory mount 300 includes two hinge portions 330 arranged near the sides of the body 310. The hinge portions 330 have a zig zag shape extending between the body 310 and the moveable arm 320. When the accessory mount 300 is actuated by pinching the bottom and top actuation portions 312, 322, the hinge portions 330 deform in a spring-line manner at each side of the accessory mount 300 so that the moveable arm 320 moves towards the body 310 while maintaining a horizontal orientation. The travel of the hinge portion 330 allows the moveable top tab 324 to retract toward the body 310 enough that the accessory mount 300 can be installed or removed from the recess of the helmet shroud. Like the accessory mounts 100, 200 described above, the hinge portions 330 resists actuation force applied to the moveable arm 320 so that the accessory mount 300 is not inadvertently released from the helmet shroud.

Referring now to FIGS. 10-32, an exemplary accessory mount 400 is shown. The accessory mount 400 has a body 410 having a bottom actuating portion 412 and a fixed bottom tab 414. A moveable arm or portion 420 is hingeably attached to the body 410 by a hinge portion 430 arranged at a left side of the body 410. The moveable arm 420 includes a top actuating portion 422 and a moveable top tab 424. An accessory mounting portion 440 extends from the body 410 for attaching an accessory to the accessory mount 400. An optional locking member 450 can be provided on the body 410 or the moveable arm 420 that can be actuated to prohibit actuation of the moveable arm 420.

Figure 10:
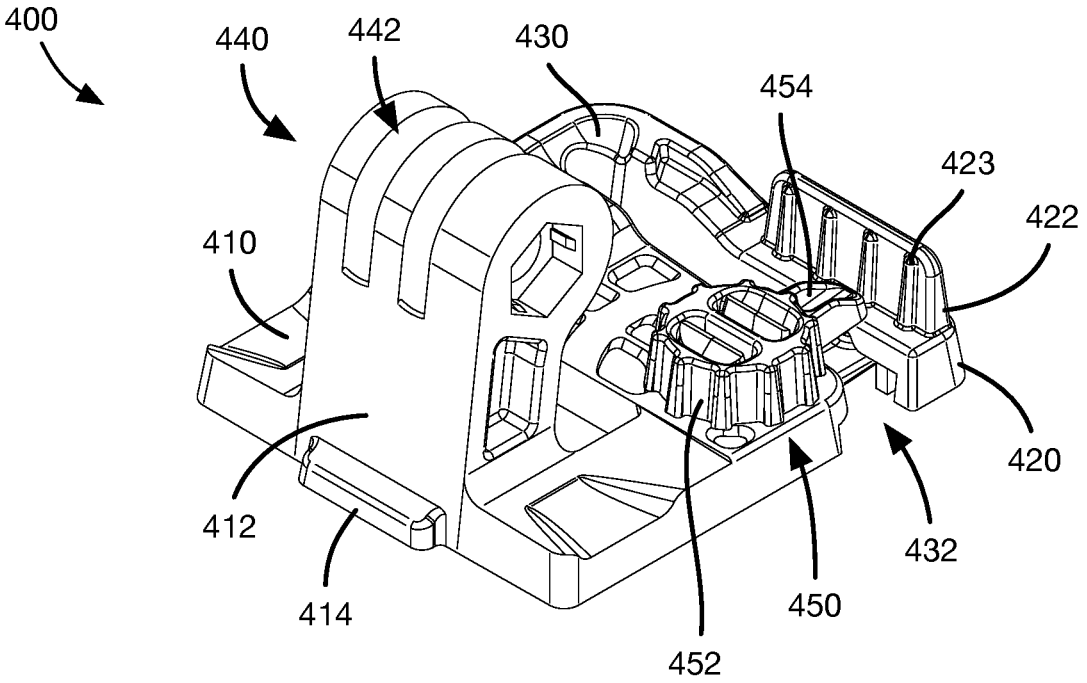
FIG. 10 is a front perspective view of an exemplary accessory mount with a locking member in a locked position.
Figure 11:
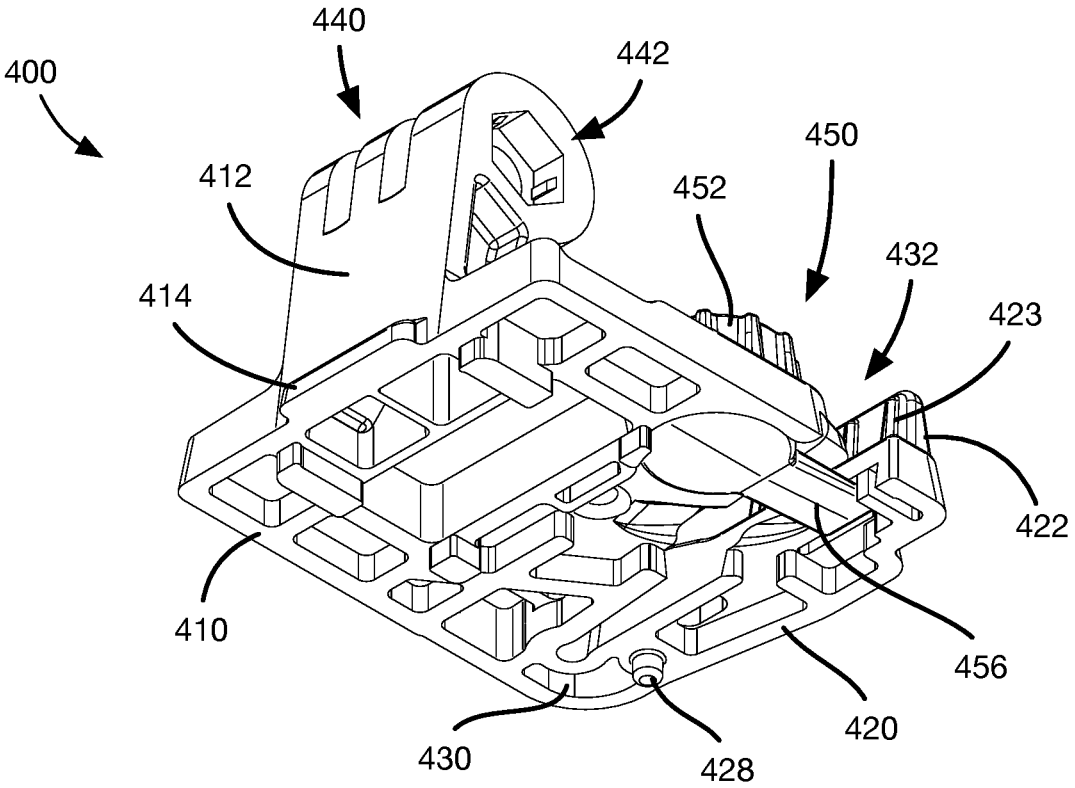
FIG. 11 is a rear perspective view of the accessory mount of FIG. 10.
Figure 12:
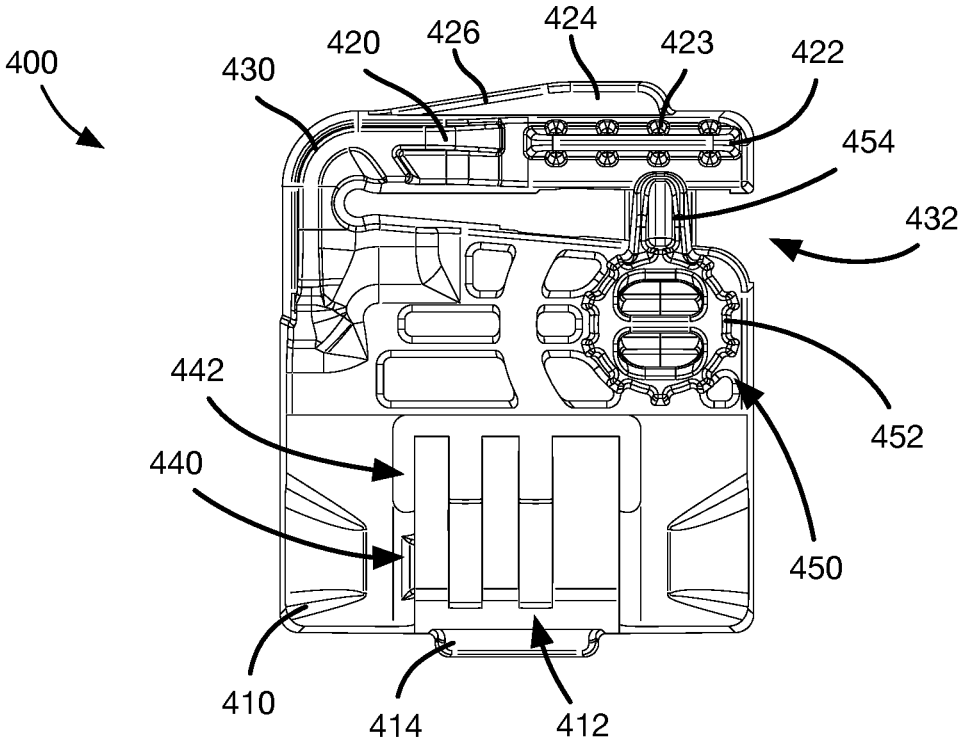
FIG. 12 is a front view of the accessory mount of FIG. 10.
Figure 13:
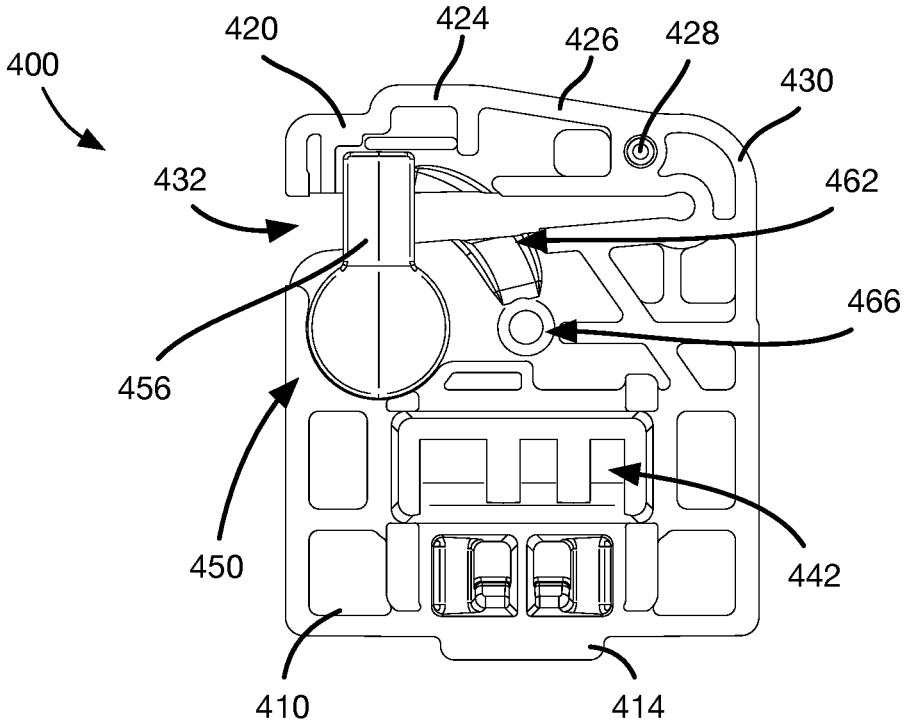
FIG. 13 is a rear view of the accessory mount of FIG. 10.
Figure 14:
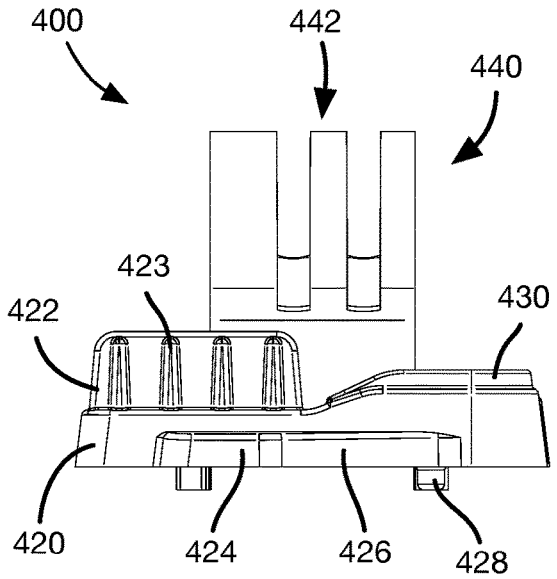
FIG. 14 is a top view of the accessory mount of FIG. 10.
Figure 15:
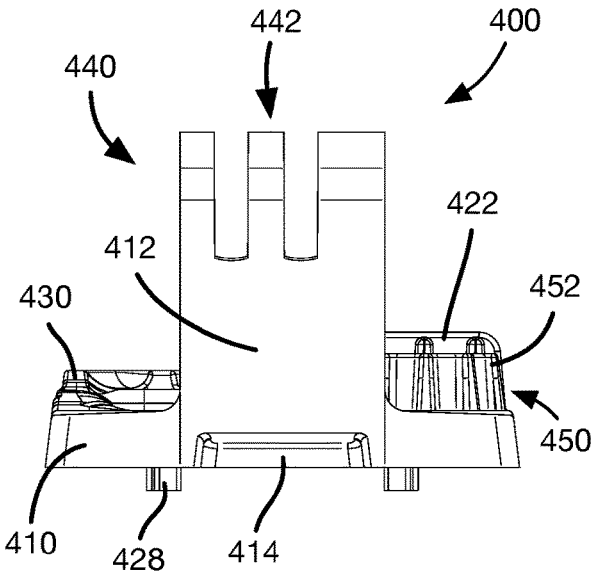
FIG. 15 is a bottom view of the accessory mount of FIG. 10.
Figure 16:
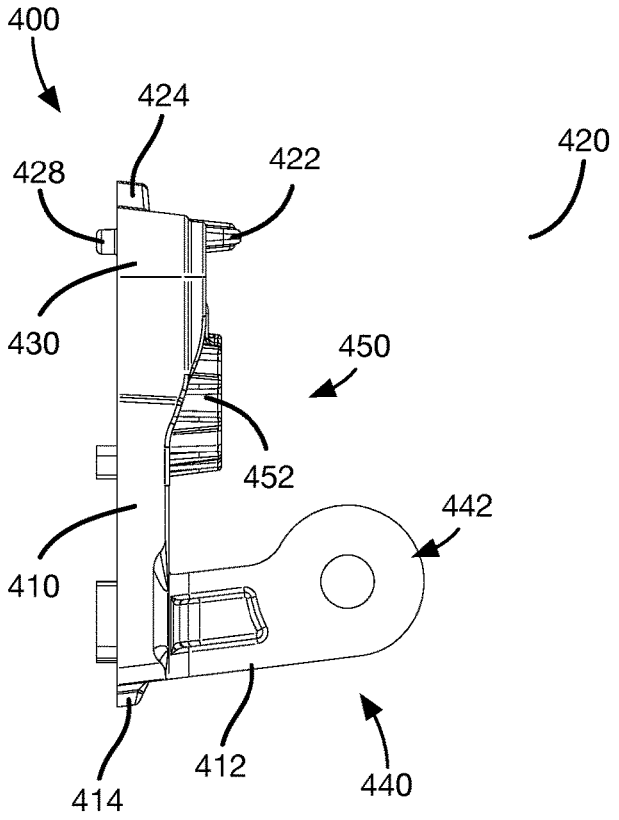
FIG. 16 is a left side view of the accessory mount of FIG. 10.
Figure 17:
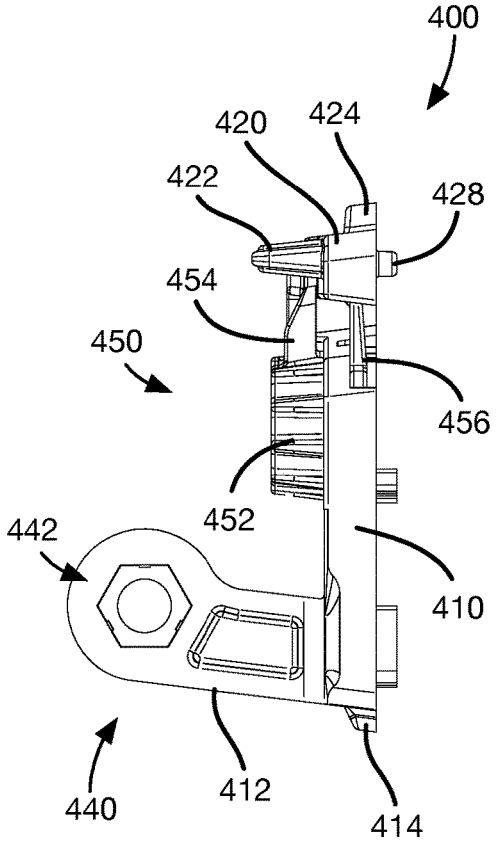
FIG. 17 is a right side view of the accessory mount of FIG. 10.
Figure 18:
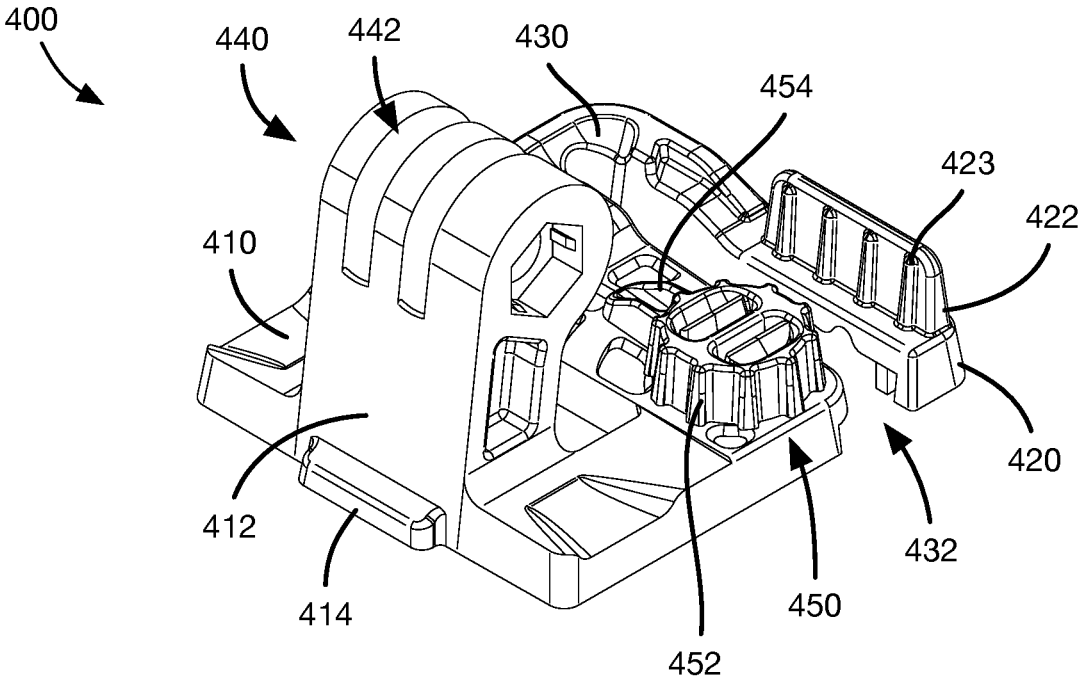
FIG. 18 is a front perspective view of an exemplary accessory mount with a locking member in an unlocked position.
Figure 19:
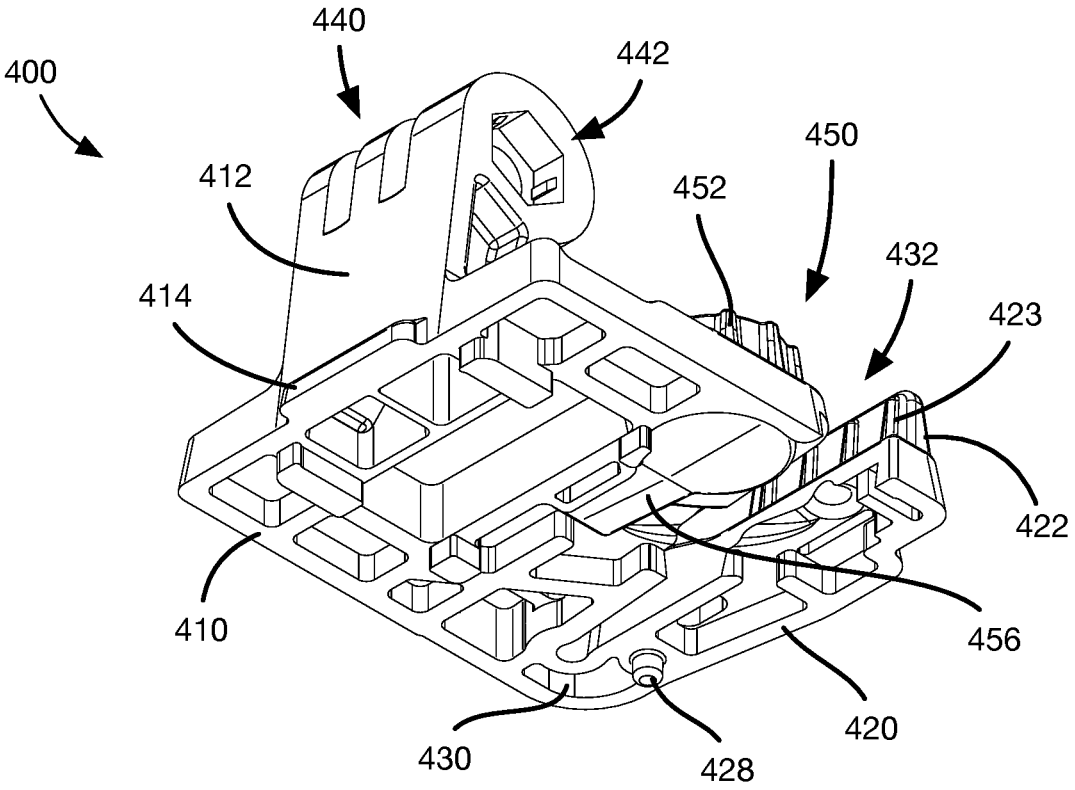
FIG. 19 is a rear perspective view of the accessory mount of FIG. 18.
Figure 20:
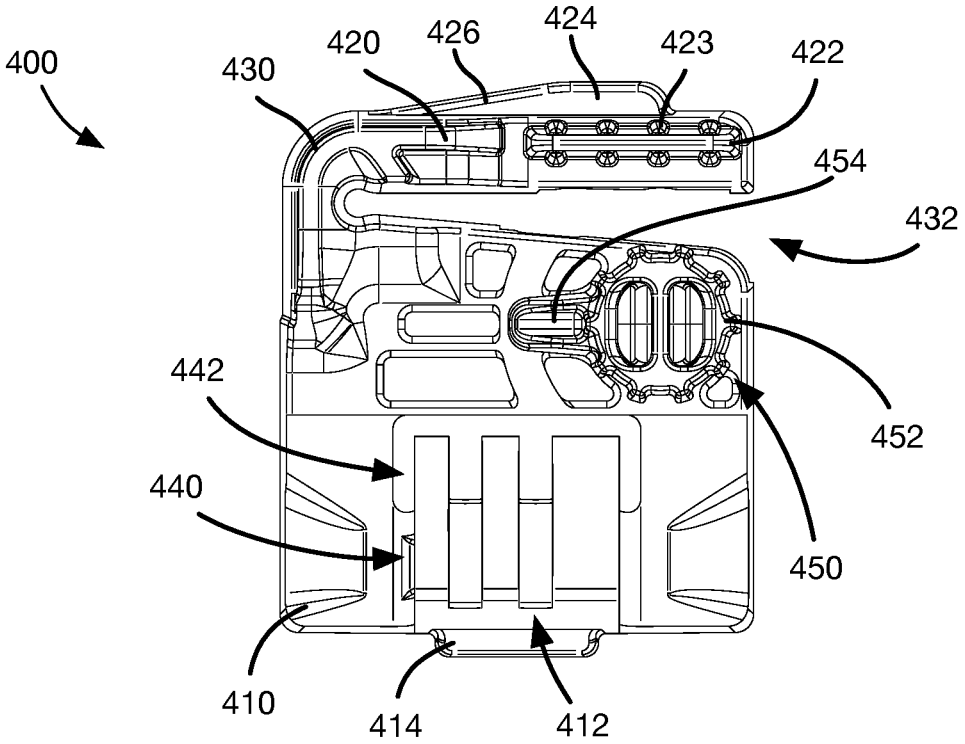
FIG. 20 is a front view of the accessory mount of FIG. 18.
Figure 21:
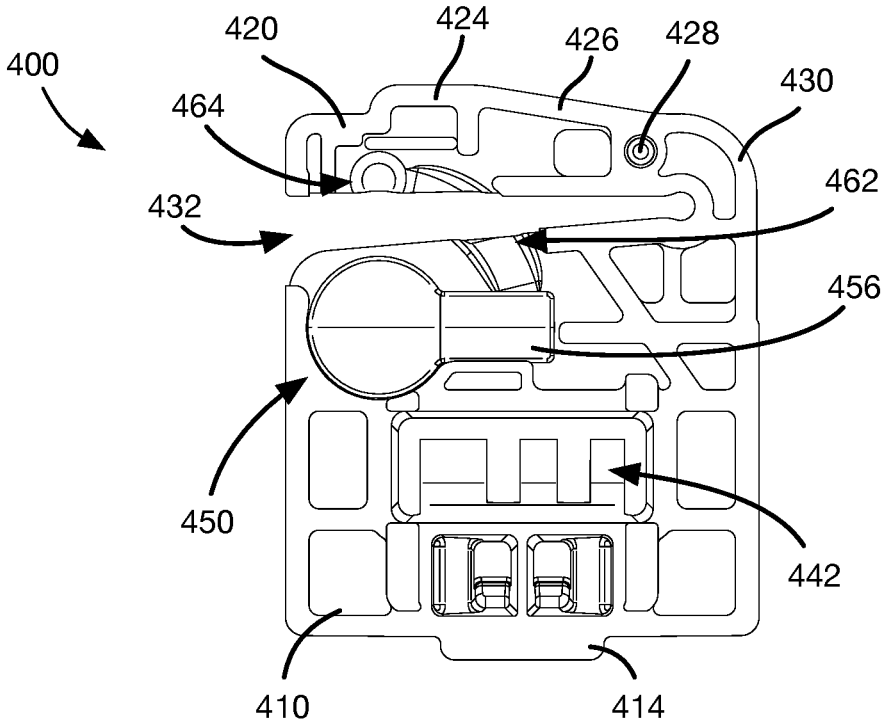
FIG. 21 is a rear view of the accessory mount of FIG. 18.

As can be seen in FIG. 12, the body 410 has a generally rectangular shape with rounded corners and is configured to fit within the rectangular recess of a helmet shroud (not shown). The body 410 can be any shape that corresponds to the recess or receptacle of a helmet. The rectangular shape of the body 410 as shown in FIGS. 10-21 prohibits the rotation of the mount 400 within a similarly shaped recess of a helmet shroud.

The bottom actuation portion 412 extends outward from the body 410 proximate the location of the fixed bottom tab 414. The bottom actuation portion 412 is configured to receive actuation force applied by the fingers of the wearer of the helmet. As can be seen in FIGS. 10 and 11, the bottom actuation portion 412 is integrally formed with the accessory mounting portion 440. In some embodiments, the bottom actuation portion 412 can include grip enhancing features—such as ridges or bumps—on the bottom actuation portion 412.

The fixed bottom tab 414 extends from the bottom of the body 410 and has a rounded rectangular shape. The fixed bottom tab 414 is shaped to conform to a recess in the bottom side of the rectangular recess of the helmet shroud. That is, the fixed bottom tab 414 is roughly the same width as the recess so as to prohibit lateral movement of the fixed bottom tab 414 and, consequently, the accessory mount, within the recess of the shroud.

The moveable arm 420 extends from the hinge portion 430 along the top of the accessory mount 400. The moveable arm 420 can be configured to conform to the shape of the top edge of the rectangular recess of the helmet shroud. The moveable arm 420 is moveable toward the body 410 to retract and extend the moveable tab 424. The hinge portion 430 biases the moveable arm 420 in an opening direction so that the moveable arm 420 remains in contact with or close to a top edge of the shroud recess so that the moveable top tab 424 remains engaged with the shroud. The moveable arm 420 optionally includes a pin 428 that extends below the moveable arm 420 to engage features of certain helmet shrouds (not shown) to restrict lateral movement of the accessory mount 400.

The top actuation portion 422 extends outward from the moveable arm 420 proximate the end of the moveable arm 420—that is, at a distance from the hinge portion 430—to provide leverage when applying an actuation force to actuate the moveable arm 420. The top actuation portion 422 is configured to receive actuation force applied by the fingers of the wearer of the helmet. In embodiments where the accessory attached to the accessory mount 400 does not extend vertically above the accessory mounting portion 440, the top actuation portion 422 extends away from the moveable arm 420 more than the bottom actuation portion 412 extends from the body 410 to provide a large surface for actuating the accessory mount 400. In certain embodiments, the actuation portion 422 includes grip enhancing features 423 that improve the grip of the user when actuating the top actuation portion 422, such as ridges shown in FIGS. 10-21. The grip enhancing features 423 also enable the user to feel the location of the top actuation portion 422 without looking so that the top actuation portion 422 can be actuated without removing the helmet.

The moveable top tab 424 extends from the top of the moveable arm 420 and has a rounded rectangular shape on the side furthest from the hinge portion 430 and an incline or ramp portion 426 on the side nearest the hinge portion 430. The moveable top tab 424 is shaped to conform to a recess in the top side of the rectangular recess of the helmet shroud. That is, the moveable top tab 424 is roughly the same width as the recess so as to prohibit lateral movement of the moveable top tab 424 and, consequently, the accessory mount, within the recess of the shroud.

The accessory mount 400 is actuated by pinching the bottom and top actuating portions 412, 422 together to cause the moveable arm 420 to move toward the body 410, thereby retracting the moveable top tab 424 so that the accessory mount 400 can fit within the recess of the helmet shroud. Alternatively, actuation force is applied to the top actuation portion 422 while the bottom tab 414 is engaged with the helmet shroud so that upward force does not need to be applied to the bottom actuating portion 412 to actuate the accessory mount 400.

The hinge portion 430 allows the moveable arm 420 to pivot relative to the body 410 of the accessory mount 400. The hinge portion 430 is formed from the same material as the body 410 and moveable arm 420 and is a "living hinge" in that the hinge portion 430 elastically deforms as an actuation force is applied to the actuation portion 422 of the moveable arm 420 causing the moveable arm to flex toward the body 410 and returns to a neutral position when the actuation force is removed. That is, the hinge portion 430 operates as a rotational spring that resists deformation and generates a restorative force when a force causing the deformation subsides. The shape and thickness of the hinge portion 430 is selected to provide a desired resistance to bending or actuation of the moveable arm 420 so that the accessory mount 400 remains attached to the helmet shroud. In some embodiments, the hinge portion 430 can be thicker than the body 410, such as about twice as thick as the body 410.

The hinge portion 430 spaces the moveable arm 420 apart from the body 410 to form a gap 432 that is reduced as the moveable arm 420 is actuated. As can be seen in FIG. 12, the gap 432 widens as the gap 432 extends away from the hinge portion 430. The widening of the gap 432 provides clearance for the movement of the moveable arm 420 during actuation and is configured such that when the movable arm 420 is at or near a maximum actuation position where the moveable arm 420 is in contact with the body 410, the tapered portion 426 of the moveable top tab 424 is approximately horizontal so that the moveable top tab 424 clears the top side of the shroud recess and the accessory mount 400 can be removed from the shroud.

The accessory mounting portion 440 can take many forms, such as the hinge mount shown in FIGS. 10-21. In the illustrated embodiment, a hinge portion 442 is formed at a distal end of the accessory mounting portion 440 for receiving a similar hinge portion (not shown) of an accessory, such as, for example, a GoPro® camera. In certain embodiments, the accessory mounting portion 440 can be configured as a mounting plate (not shown) instead of the hinge mount for attaching accessories through any suitable attachment or fastening means, such as, for example, with bolts, screws, clips, tabs, or posts.

In the illustrated embodiment, the accessory mounting portion 440 is configured as a hinge mount with the hinge portion 442 that is spaced apart from the body 410 to provide clearance for movement of the camera (not shown) attached to the hinge portion 442. The hinge mount configuration of the accessory mounting portion 440 can be used to secure the hinge of a compact camera, such as a GoPro® camera. Compact mobile cameras with such hinge mounts are common for attaching on various vehicles or for wearing on the head or on a helmet. Typically helmets with shrouds do not have an interface for receiving the mounting portion of such compact cameras that can firmly attach the camera to the helmet and reliably maintain the position of the camera. Thus, when the shroud is positioned in the front center of the helmet, as current shrouds typically are, the accessory mount 400 further serves to center the headlamp on the helmet.

The accessory mount 400 is attached to the helmet shroud by first aligning or locating the bottom fixed tab 414 in the bottom recess of the shroud. Actuation force is then applied to the top actuation portion 422 to move the moveable arm 420 toward the body 410 so that the moveable top tab 424 can fit within the recess of the shroud. The accessory mount 400 (and any attached accessory) are then tilted backward toward the helmet until the accessory mount 400 is fully inserted into the recess of the shroud. The actuation force is then released and the hinge portion 430 causes the moveable arm 420 to move away from the body 410 so that the moveable top tab 424 is inserted into the top recess of the helmet shroud, thereby securing the accessory mount within the shroud recess.

The accessory mount 400 is removed from the helmet shroud by first applying actuation force to the top actuation portion 422 to move the moveable arm 420 toward the body 410 so that the moveable top tab 424 is retracted from the recess of the helmet shroud. The accessory mount 400 (and any attached accessory) are then tilted forward away from the helmet until the top of accessory mount 400 is fully removed from the recess of the shroud. The accessory mount 400 and attached accessory can then be lifted away from the helmet.

In certain embodiments, a distance from the top of the moveable arm to the top of the body is less than about 30 percent, or less than about 25 percent, or less than about 20 percent, or less than about 45 percent of a total height of the accessory mount. Thus, a flexible portion of the accessory mount 400—i.e., the moveable arm 420 and hinge portion 430—makes up less than 30 percent of the total height of the accessory mount 400. Consequently, the body 410 of the accessory mount 400 is about 70 percent or less of the total height of the accessory mount 400. The relative proportions of the body 410 and the flexible portion of the accessory mount 400 provide further resistance to the rotation of the accessory mount 400 within the recess of the helmet shroud.

External forces, such as gravity or forces from impacts with other objects, exerted on the mounted accessory are transmitted through the accessory mounting portion 440 to the body 410 of the accessory mount 400 and then to the helmet shroud. Lateral and downward forces applied to the accessory mount 400 have little or no impact on the position or actuation of the moveable arm 420 so that later and downward forces are not capable of inadvertently actuating the movable arm 420 to release the accessory mount 400 from the shroud. Without any accessory attached to the accessory mounting portion 440, upward forces similarly have little or no impact on the position or actuation of the moveable arm 420 in that the moveable arm 420 pivots at the hinge portion 430 which is arranged at one side of the accessory mount 400. The bottom fixed tab 414 and the pin 428 also aid restricting lateral movement of the accessory mount 400. However, when heaver accessories—such as compact portable cameras—are attached to the accessory mounting portion 440, in certain conditions the weight of the attached accessory and the extension of the accessory mounting portion 440 away from the body generate greater torque forces on the accessory mount 400 that can cause the moveable arm 420 to be inadvertently actuated such that the body 410 moves upward enough for the fixed bottom tab 414 to come out of the shroud.

The optional locking member 450 shown attached to the body 410 of the accessory mount 400 in FIGS. 10-21 can be provided to deter such inadvertent actuations of the moveable arm 420. The optional locking member 450 includes a knob portion 452, a front locking protrusion 454, a rear locking protrusion 456, and a retaining member 458. The locking member 450 is rotatable between a locked position (FIGS. 10-13) and an unlocked position (FIGS. 18-21) by applying a rotational force to the knob portion 452 at the front of the locking member 450. In the locked position, the front and rear locking protrusions 454, 456 extend from the body 410 to engage the moveable arm 420. The rear locking protrusion 456 can also include a positioning retaining member or detent 458 that engages the body 410 and/or the moveable arm 420 to prohibit rotation of the locking member 450 out of the locked and unlocked positions absent intention application of a twisting force by the user to the knob portion 452.

Figure 22:
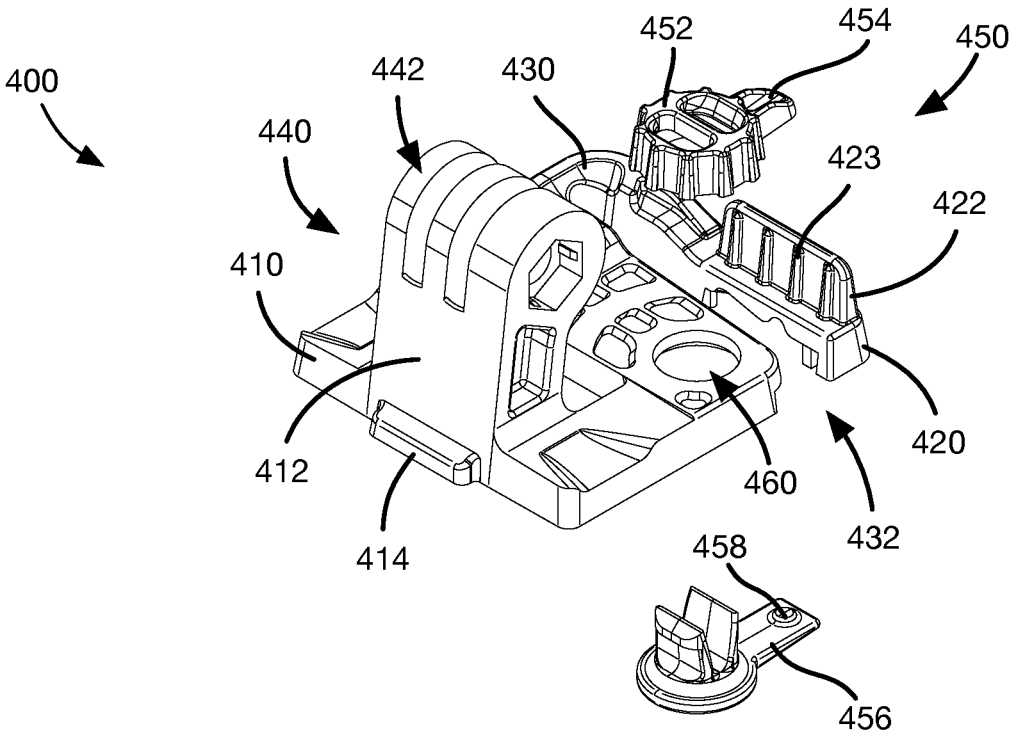
FIG. 22 is a front perspective view of the accessory mount of FIG. 18 with the locking member in an exploded condition.
Figure 23:
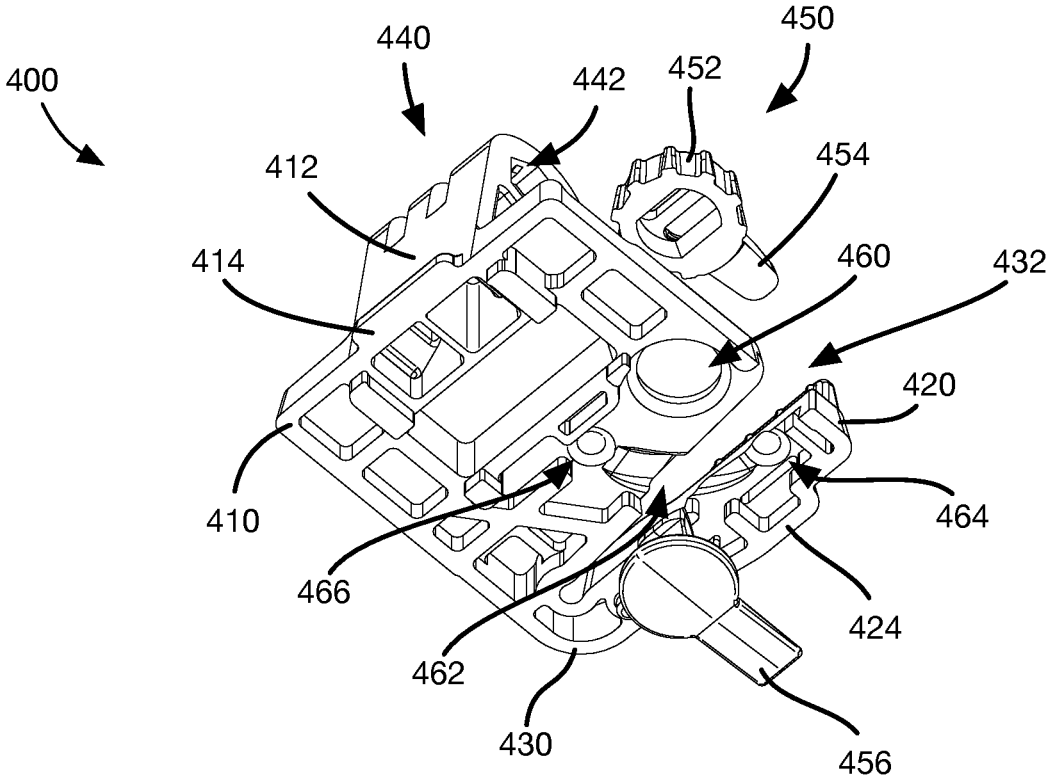
FIG. 23 is a rear perspective view of the accessory mount of FIG. 22.
Figure 24:
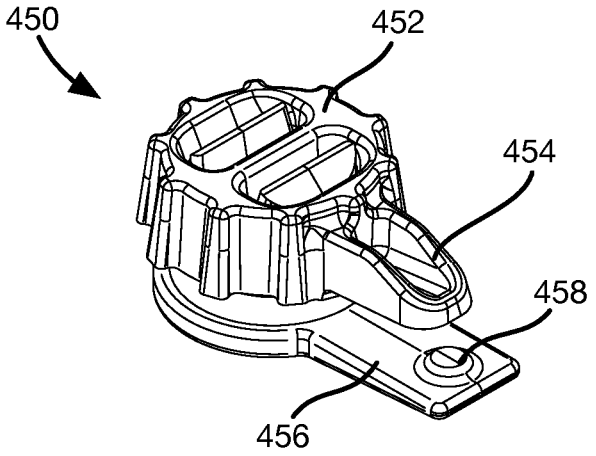
FIGS. 24-29 show an exemplary locking member in an assembled condition.
Figure 25:
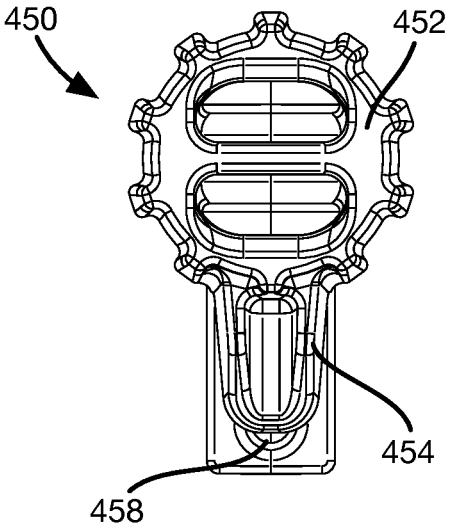
Figure 26:
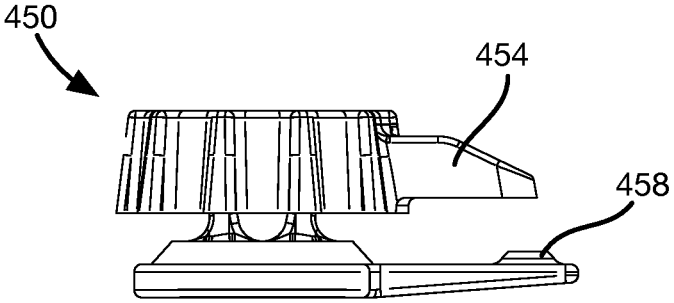
Figure 27:
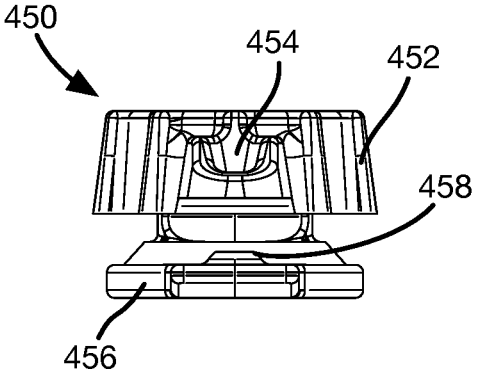
Figure 28:
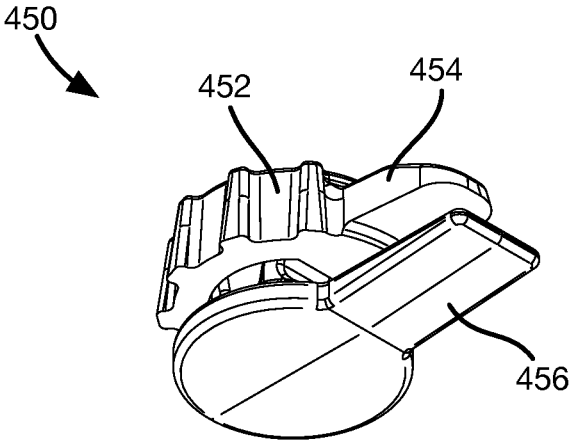
Figure 29:
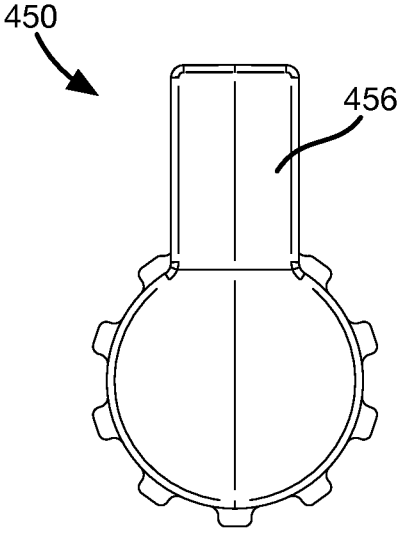
Figure 30:
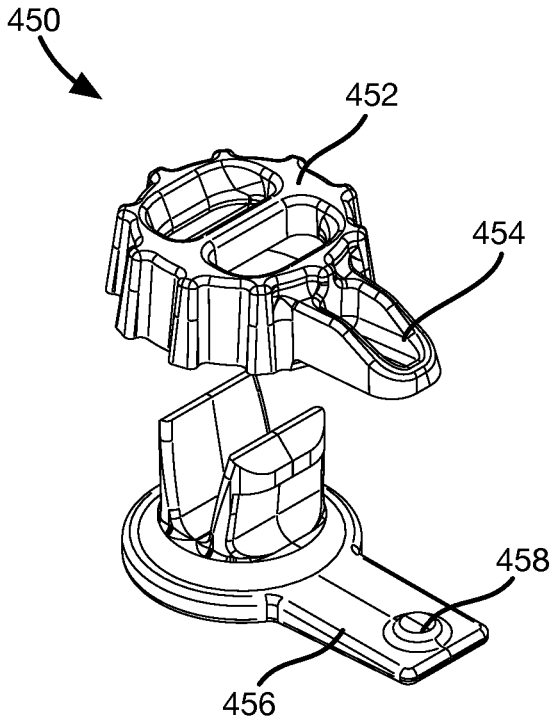
FIGS. 30-32 show the locking member of FIGS. 24-29 in an exploded condition.
Figure 31:
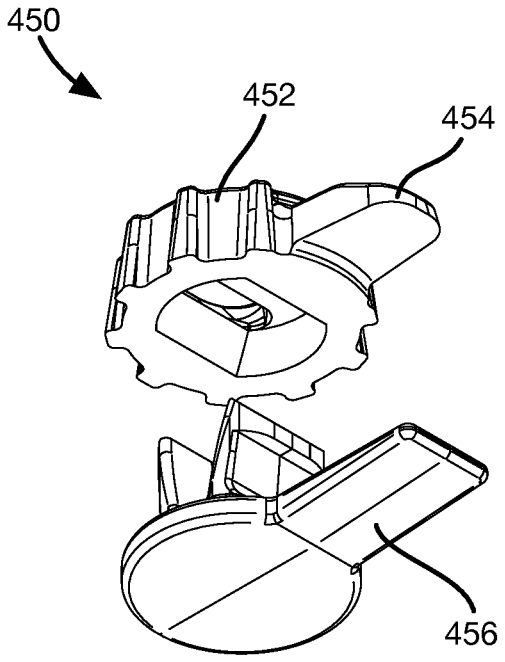
Figure 32:
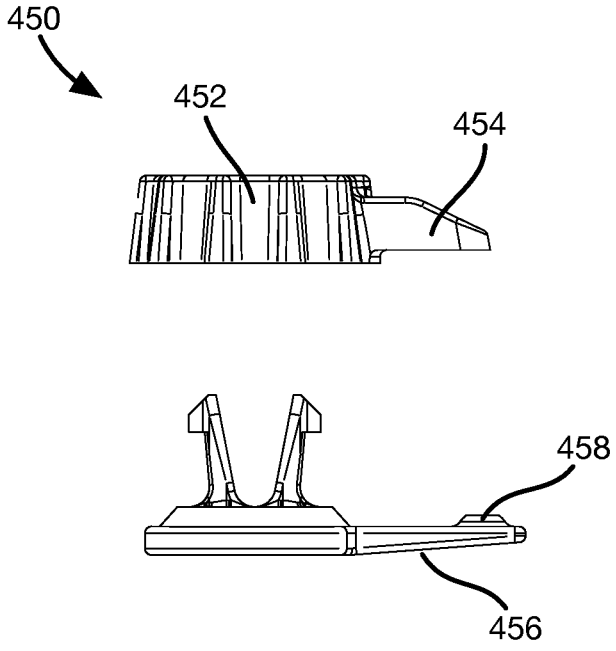

Referring now to FIGS. 22 and 23, an exploded view of the locking member 450 and body 410 is shown. The locking member 450 is formed from front and rear portions that snap together through a lock pivot hole 460. An arcuate groove 462 formed in the rear of the body 410 and the moveable arm 420 provides clearance for the rear locking protrusion 456 as the locking member 450 is rotated between the locked and unlocked positions. A locked position recess 464 is provided an end of the arcuate groove 462 on the moveable arm 420 and an unlocked position recess 466 is provided at the other end of the arcuate groove 462 on the body 410. The locked and unlocked position recesses 464, 466 are shaped to receive the position retaining member or detent 458 so that the locking member 450 is retained in the locked or unlocked position absent force applied to the knob 452 by the user.

While the locking member 450 is shown assembled to the body 410 (FIGS. 10-21), the locking member 450 could be assembled to the moveable arm 420 and function similarly to prohibit inadvertent actuation of the moveable arm 420 relative to the body 410. Additionally, the locking member 450 can be formed out of a single piece of material that is attached to the body 410 or moveable arm 420. In some embodiments, the locking member 450 can be attached only from one side of the body 410 or moveable arm 420.

Referring now to FIGS. 24-32, the locking member 450 is shown in an assembled condition (FIGS. 24-29) and a disassembled condition (FIGS. 30-32) to more clearly show the various features of the locking member 450.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. An accessory mount for securing an accessory to a helmet, the accessory mount comprising: a body having a top, a bottom, a first side, and a second side; a fixed tab extending from the bottom of the body;

a moveable arm arranged at the top of the body; a hinge portion hingeably attaching the moveable arm to the top of the body proximate one of the first and second sides, wherein a gap is formed between the moveable arm and the top of the body by the hinge portion; and a moveable tab extending from a top of the moveable arm;

wherein the moveable arm is moveable between an unactuated position and an actuated position; and wherein the gap between the moveable arm and the top of the body is reduced as the moveable arm is moved from the unactuated to the actuated position; wherein the body, moveable arm, and hinge portion are formed from a single piece of material.

2. The accessory mount of claim 1, wherein a distance from the top of the moveable arm to the top of the body is less than 20 percent of a total height of the accessory mount.

3. The accessory mount of claim 1, further comprising an attachment portion extending from the body.

4. The accessory mount of claim 3, wherein the attachment portion includes at least a portion of a hinge for attaching an accessory.

5. The accessory mount of claim 1, wherein the hinge portion is thicker than the body.

6. The accessory mount of claim 1, wherein the hinge portion is about twice as thick as the body.

7. The accessory mount of claim 1, wherein the moveable arm comprises an actuation portion to facilitate actuation of the moveable arm.

8. The accessory mount of claim 1, further comprising a locking member that is moveable between a locked and an unlocked position, wherein in the locked position the lock prohibits movement of the moveable arm from the resting position to the compressed condition.

9. The accessory mount of claim 8, wherein the locking member is rotatable between the locked and unlocked positions.

10. The accessory mount of claim 8, wherein the locking member comprises a retaining portion for retaining the locking member in the locked or unlocked position until actuated by the user.

11. The accessory mount of claim 8, wherein the locking member is pivotably attached to the body.

12. The accessory mount of claim 8, wherein the locking member is pivotably attached to the moveable arm.

13. The accessory mount of claim 8, wherein the locking member comprises a plurality of portions that are joined together to assemble the locking member to one of the body and the moveable arm.

14. The accessory mount of claim 1, wherein the moveable tab includes a tapered portion.

* * * * *